US009340388B2

(12) United States Patent
Nash et al.

(10) Patent No.: US 9,340,388 B2
(45) **Date of Patent: *May 17, 2016**

(54) TAPE SPLICING SYSTEMS AND METHODS

(71) Applicant: Adalis Corporation, Vancouver, WA (US)

(72) Inventors: Jorge A. Nash, Vancouver, WA (US); Orion A. Cavins, Vancouver, WA (US); Cynthia A. Stewart-Irvin, Battle Ground, WA (US)

(73) Assignee: ADalis Corporation, Vancouver, WA (US)

( * ) Notice: Subject to any disclaimer, the term of this patent is extended or adjusted under 35 U.S.C. 154(b) by 10 days.

This patent is subject to a terminal disclaimer.

(21) Appl. No.: 14/332,022

(22) Filed: Jul. 15, 2014

(65) Prior Publication Data

US 2015/0008277 A1 Jan. 8, 2015

Related U.S. Application Data

(63) Continuation of application No. 13/041,112, filed on Mar. 4, 2011, now Pat. No. 8,807,474.

(51) Int. Cl.
*B65H 19/18* (2006.01)

(52) U.S. Cl.
CPC .. *B65H 19/1852* (2013.01); *B65H 2301/46325* (2013.01)

(58) Field of Classification Search
CPC ..... B65H 19/1873; B65H 2301/46325; B65H 19/1852; B65H 2701/37; B65H 19/1836
See application file for complete search history.

(56) References Cited

U.S. PATENT DOCUMENTS 3,072,354 A * 1/1963 Giles ..... B65B 41/12 242/554.4
4,010,911 A * 3/1977 Heitmann ..... B65H 19/1852 156/505

(Continued)

*Primary Examiner* — Emmanuel M Marcelo
*Assistant Examiner* — Michael Gallion
(74) *Attorney, Agent, or Firm* — Kirsten Stone; Bin Su

(57) ABSTRACT

Disclosed herein are embodiments of a tape splicing system for coupling a leading end of a staged tape to a trailing end of a running tape to form a continuous tape. The splicing system can comprise a connector having an opening for allowing the running tape to pass through, a leading end element having an opening for engaging the connector, and a trailing end element. The leading end element can be secured to the leading end of the staged tape and the trailing end element can be secured to the trailing end of the running tape. The connector can couple the leading end element to the trailing end element to splice the staged tape to the running tape.

18 Claims, 15 Drawing Sheets

(56) References Cited

U.S. PATENT DOCUMENTS 4,022,396 A * 5/1977 Manchester ..... B65H 49/12 242/129
4,262,855 A * 4/1981 Haag ..... B65H 19/1873 156/504
4,572,460 A * 2/1986 Hertrich ..... G11B 23/26 226/92
4,917,327 A * 4/1990 Asbury, Jr. ..... B65H 19/123 242/125.1
5,029,768 A * 7/1991 Asbury, Jr. ..... B65H 19/123 242/553
5,474,208 A * 12/1995 Ball ..... A47F 9/043 221/1
5,586,831 A * 12/1996 Tsubota ..... B21B 15/0085 226/92
5,740,983 A * 4/1998 Earle ..... G03D 13/005 242/348.3
5,989,792 A * 11/1999 Miyai ..... G03D 13/003 242/551
6,325,324 B1 * 12/2001 Getz ..... B65H 19/1852 242/555.2
6,439,489 B1 * 8/2002 Hoge ..... G11B 15/67 242/332.4
6,596,111 B2 * 7/2003 Cyr ..... B65H 19/102 156/157
6,622,959 B2 * 9/2003 Robitaille ..... B65H 19/1831 156/502
6,981,537 B2 * 1/2006 Cyr ..... B65H 19/102 156/358
7,322,541 B2 * 1/2008 Fairchild ..... B65H 19/1836 242/421.8
7,681,829 B2 * 3/2010 Cyr ..... B65H 19/1852 242/551
7,819,354 B2 * 10/2010 Robitaille ..... B65H 59/04 156/494
8,807,474 B2 * 8/2014 Nash ..... B65H 19/1852 242/555.6
2007/0018030 A1 * 1/2007 Bradshaw ..... B65H 19/102 242/552
2008/0212929 A1 * 9/2008 Carpenter ..... G02B 6/4471 385/135
2009/0200414 A1 * 8/2009 Maness ..... B65H 19/1831 242/553
2010/0123037 A1 * 5/2010 Nash ..... B65H 19/1836 242/555

* cited by examiner

TAPE SPLICING SYSTEMS AND METHODS

FIELD

The present disclosure concerns systems and methods for splicing an unwinding roll of material to a staged roll of material, such as tape.

BACKGROUND

Modern consumer and industrial packaging often includes reinforcing tapes or tear tapes as part of their construction. Various tape dispensers have been designed to dispense such tapes into corrugator and packaging equipment. Known tape dispensers include a first spindle that supports an unwinding roll of tape and a second spindle that supports a stationary, or staged, roll of tape. To provide a continuous feed of tape, splicing techniques have been developed for splicing together the trailing end of the unwinding roll of tape to the leading end of the staged roll of tape.

SUMMARY

Disclosed herein are embodiments of tape splicing systems and methods for splicing a leading end of a staged tape to a trailing end of a running tape to form a continuous tape. The splicing system can comprise a connector having an opening for allowing the running tape to pass through, a leading end element having an opening for engaging the connector, and a trailing end element. The leading end element can be secured to the leading end of the staged tape and the trailing end element can be secured to the trailing end of the running tape. The connector can couple the leading end element to the trailing end element to splice the staged tape to the running tape.

In some embodiments, the connector comprises a first end portion and a second end portion spaced from the first end portion, the opening of the connector is in the first end portion and the securing portion is at the second end portion.

In some embodiments, the connector has a thickness of less than 2 mm. In some embodiments, the opening of the connector is enclosed.

In some embodiments, the leading end splicing element is thinner and more pliant than the connector. For example, the leading end splicing element can comprise a fabric, such as a woven fabric.

In some embodiments, the securing portion of the connector comprises a neck portion and a foot portion, with the neck portion being narrower than the foot portion. The leading end splicing element is engagable with the connector such that the opening of the leading end splicing element is positioned around the neck portion of the connector and the foot portion of the connector inhibits the leading end splicing element from disengaging from the connector when a splice is formed.

In some embodiments, the connector also includes a break communicating with the opening of the connector and a peripheral edge of the connector such that the running tape is insertable through the break into the opening of the connector while the running tape is running. In some of these embodiments, the securing portion of the connector comprises first and second foot portions, the break extends between the foot portions, and tension in the splicing system causes the leading end splicing element to grip the foot portions. The break can be a slot. In such embodiments, when a splice is formed, tension in the splicing system can cause the leading end splicing element to urge the foot portions toward each other. The leading end splicing element can also inhibit the running tape from moving out of the connector opening through the slot. Furthermore, the leading end splicing element can bridge the slot and closes the path of communication between the opening in the connector and the peripheral edge of the connector.

In some embodiments, the trailing end portion of the running tape roll includes a tail secured to a core of the running tape roll such that the running tape remains in tension until the trailing end splicing element approaches or contacts the connector.

In some embodiments, the connector is comprised primarily of polymeric material, such as a material that melts when heated.

Exemplary methods disclosed herein can comprise 1) dispensing a running tape from a running roll, a first splicing element being positioned around the running tape such that the running tape runs through an opening in the first splicing element; and 2) while the running tape is being dispensed through the first splicing element, securing a leading end of a staged tape to the splicing element; whereby when the running roll becomes depleted of tape, a second splicing element at a trailing end of the running tape engages the first splicing element positioned around the running tape to splice the running tape to the staged tape.

In some embodiments, the first splicing element is pre-installed around the running tape on the running roll before the running tape is dispensed from the roll.

In some embodiments, the first splicing element is placed around the running tape during the dispensing of the running tape from the roll.

In some embodiments, the leading end of the staged tape is secured to the first splicing element with a third splicing element. In some of these embodiments, the third splicing element is more pliant that the first splicing element and the third splicing element comprises a loop that engages around the first splicing element.

In some embodiments, the leading end of the staged tape is secured to the first splicing element with an adhesive.

In some embodiments, method further comprises: 3) prior to dispensing the running tape from the running roll, positioning the first splicing element in a releasable holding mechanism, which holds the first splicing element relatively stationary while tape is dispensed from the running roll and then releases the first splicing element when the splice is formed.

An exemplary splicing apparatus comprises a body portion having an opening, a neck portion extending from the body portion, a foot portion extending from the neck portion and spaced from the body portion, the neck portion being narrower than the foot portion, and a break extending from the opening through the body, neck and foot portions such that the break divides the neck and foot portions into two separate parts connected by the body portion, the break being configured to allow the splicing apparatus to be placed around an intermediate portion of a first tape while the tape is running under tension such that the first tape runs through the opening. The neck and foot portions are configured to engage a splicing element of a second tape such that when tension is applied to the second tape during a splice, the neck and foot portions are urged toward each other to inhibit the first tape from passing through the break.

In some embodiments, the splicing apparatus has a maximum thickness of less than 2 mm. In some embodiments, the connector is a single piece of a thermoplastic material.

The foregoing and other objects, features, and advantages of the invention will become more apparent from the following detailed description, which proceeds with reference to the accompanying figures.

DETAILED DESCRIPTION

The present disclosure concerns apparatuses and methods for splicing an unwinding roll of tape to a staged roll of tape. The following description is exemplary in nature and is not intended to limit the scope, applicability, or configuration of the invention in any way.

As used herein, the singular forms "a," "an," and "the" include the plural forms unless the context clearly dictates otherwise. Additionally, the term "includes" means "comprises." Further, the term "coupled" means physically (e.g., mechanically or chemically) linked and does not exclude the presence of intermediate elements between the coupled or associated items absent specific contrary language.

As used herein, the term "tape" means an elongated, thin, flexible material. For example, the term "tape" can include a reinforcing tape, a tear tape, an adhesive tape (e.g., a hot melt tape), a ribbon, a strip, a band, a string, a wire and the like.

As used herein, the term "break" means a physical discontinuity between two objects or surfaces, whether or not the two objects or surfaces are touching. One example of a break is a slot. As used herein, the term "slot" means a break wherein the two opposing objects or surfaces are not touching, absent an external force urging the two objects or surfaces together.

Figure 1:
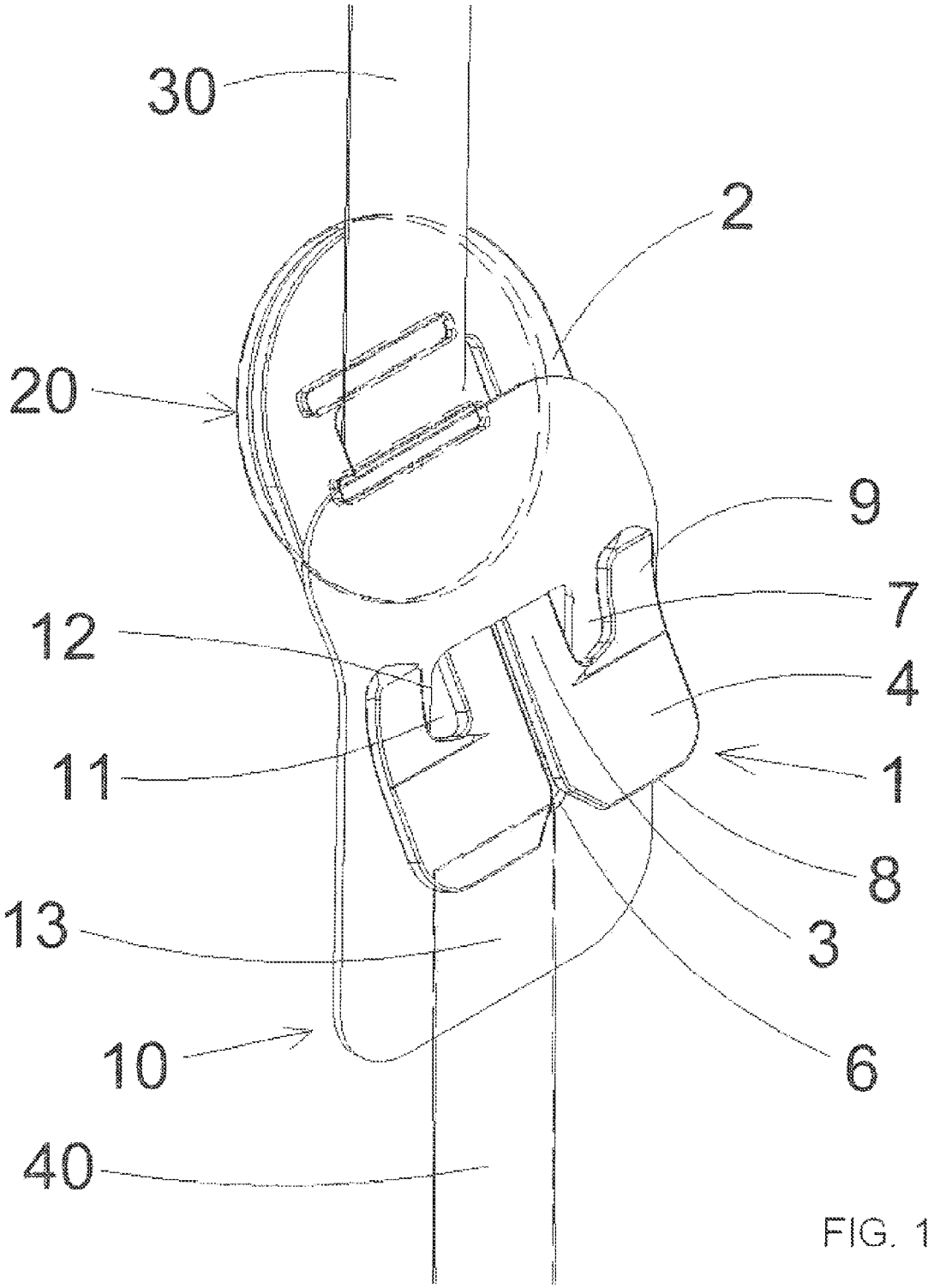
FIG. 1 shows an exemplary embodiment of a tape splicing system.

FIG. 1 shows an exemplary splicing system for splicing two tapes, according to one embodiment. Such a splicing system can couple a leading end of a staged tape 40 to a trailing end of a running tape 30 to provide a continuous supply of tape from two separate tape rolls. The splicing system can comprise a connector 1, a leading end splicing element, or leading element, 10, and a trailing end splicing element, or trailing element, 20. The leading element 10 can be secured to the leading end of the staged tape 40 and the trailing element 20 can be secured to the trailing end of the running tape 30. The connector 1 can couple the leading element 10 to the trailing element 20 to splice the staged tape 30 to the running tape 40.

The connector 1 can comprise a thin, flat piece of material, such a thermoplastic polymer. In other embodiments, the connector can be made of paper, film, or a composite laminate, for example. The connector 1 can have a maximum thickness $T_1$, such as less than 3 mm, less than 2 mm, less than 1 mm, and/or about 0.5 mm. Some embodiments of the connector 1, such as the embodiment shown in FIG. 2A, can comprise a body portion 2, a neck portion 3 and a foot portion 4. The body portion 2 can be configured to form an opening 5 that is partially or completely surrounded by the body portion. In some embodiment, the connector 1 further comprises a break 6, such as a slot, communicating with the opening 5 of the connector and a peripheral edge 8 of the connector. The break 6 can divide the neck portion 3 and the foot portion 4 of the connector 1 into two legs A and B, as shown in FIG. 2A. The connector 1 can further comprise a pair of notches 7, one in each leg, that communicate with the peripheral edge 8 of the connector, as shown in FIG. 2A. Each notch can be partially enclosed by a toe portion 9 extending from the foot portion 4.

The shape and material of the connector 1 can provide a degree of resilient flexibility that can allow the break 6 to be separated or opened temporarily to introduce a tape through the break and into the opening 5. In some embodiments, the break 6 is a slot providing a sufficient spacing between the legs A, B of the connector 1 such that the legs do not need to be further separated to introduce the tape into the opening 5. The break 6 can enable an intermediate portion of the running tape 30 to be inserted through the break and into the opening 5 of the connector while the running tape is running. For example, a person can manually position the connector 1 around the running tape 30 by inserting a side edge of the running tape into the break 6 and sliding the running tape along the break into the opening 5 such that the running tape is running through the opening while the connector is held relatively still.

Figure 2B:
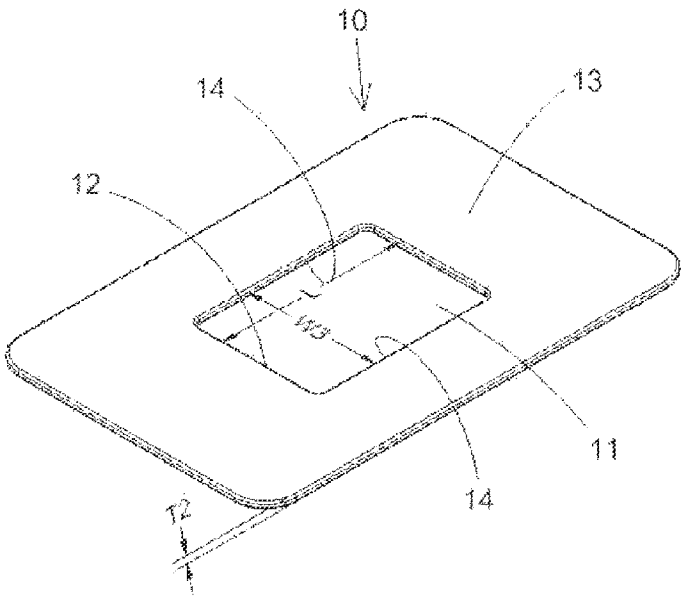
FIGS. 2A, 2B, and 2C show exemplary splicing elements of the tape splicing system of FIG. 1.

As shown in FIG. 2B, the leading end splicing element 10 can comprise a thin piece of pliant material, such as a fabric or a tape. In some embodiments, the leading element 10 fully surrounds an opening 11, forming a closed loop. The leading element 10 can have a thickness $T_2$ that is thinner than the thickness $T_1$ of the connector 1. The leading element 10 can comprise a pliant material, such as a fabric or a tape. In some embodiments, the leading element 10 can comprise a woven fabric material, optionally coated with a polymer, which can provide high flexibility, high tensile strength, and a thin profile. In some embodiments, the leading element 10 can comprise a looped portion of a tape to be dispensed rather than a separate element connected to the tape to be dispensed. In some embodiments, the leading element can partially surround an opening, such as in a hook-like configuration. In such hook-like configurations, the leading element can comprise a more rigid material, such as metal or polymer.

The leading element 10 can further comprise a connector engagement surface 12 adjacent the opening 11 and a tape engagement portion 13, as shown in FIG. 2B. The leading end of the staged tape 40 can be secured to the leading element 10, such as at the tape engagement portion 13. In some embodiments, the leading end of the staged tape 40 can extend through the opening 11 and secured back against itself to form a loop extending around the tape engagement portion 13 (see FIG. 5, for example). In other embodiments, the leading end of the staged tape 40 can be secured to the tape engagement portion 13 without passing through the opening 11, such as with an adhesive or stitching or looped through another opening created at the tape engagement portion, for example.

As shown in FIG. 1, the leading element 10 can engage connector 1 by inserting the leg portions A, B of the connector through the opening 11 of the leading element and engaging the engagement surface 12 with the notches 7. The opening 11 of the leading element 10 can have a length dimension L that is greater than a width dimension $W_3$. L can be about equal to or slightly smaller or larger than a width dimension $W_1$ of the foot portion 4 of the connector 1, such that the foot portion can be inserted through the opening 11. The leading element 10 can be deformable such that even if L is less than $W_1$, the opening can be distorted to fit around the foot portion 4 of the connector 1.

After positioning the foot portion 4 through the opening 11, the leading element 10 can be rotated, such as about 90°, such that inner surfaces 14 adjacent the opening 11 move into the notches 7. In this position, the inner surfaces 14 of the leading element 10 can be adjacent to and/or abut the neck portion 3 of the connector 1. For example, the width dimension $W_3$ of the opening can be about equal to the width $W_2$ of the neck portion 3 of the connector 1. As shown in FIG. 1, as tension is applied to the splice, the leading element 10 can pliantly deform around the neck portion 3 and the connector engagement surface 12 can slide deeper into the notches 7 toward the foot portion 4. The connector 1 can also deform to some extend to receive the leading element 10. For example, as shown in FIG. 1, the toe portions 9 can bend to receive the leading element 10 in the notches 7.

When the splicing system is under tension and the leading element 10 is engaged with the connector 1, the connector engagement surface 12 can span across the neck portion 3 between the notches 7 and bridge the break 6 such that the running tape 30 is inhibited or blocked from sliding out of the opening 5 through the break. The leading element 10 can grip the foot portions 4 such that the connector 1 can pull the leading element and the staged tape 40 to create the splice. When the splice is under tension, the pliant leading element 10 can urge the two legs A, B toward one another to reduce separation between the legs and/or cause the two legs to contact one another, thereby inhibiting the running tape 30 from sliding out of the opening 5 though the break 6.

Figure 2C:
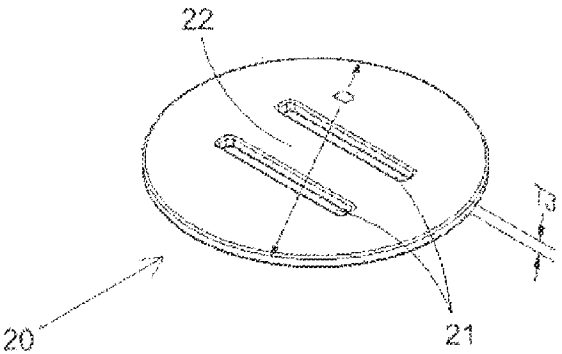
Figure 2A:
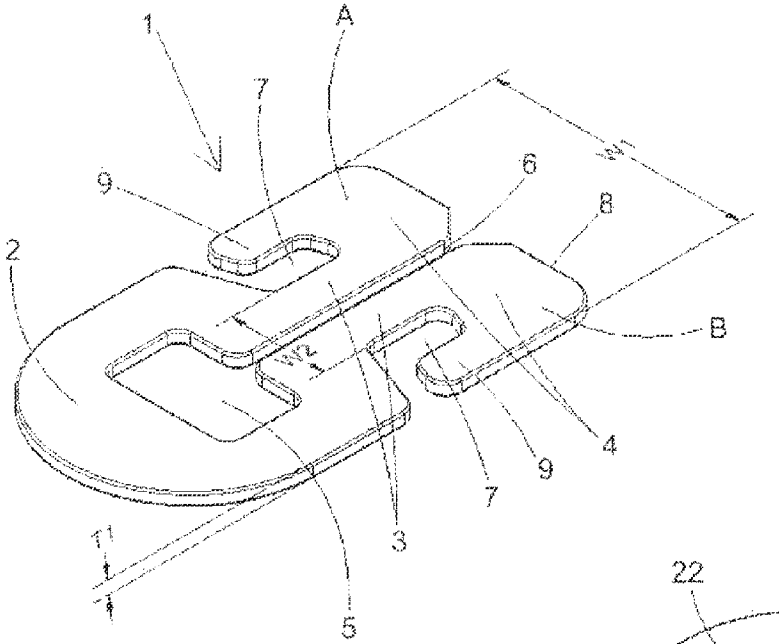

The trailing end splicing element, or trailing element, 20, can comprise a thin, flat piece of material (such as the same material as the connector 1) secured to the trailing end of the running tape 30 and configured to not be able to fit through the opening 5 in the connector 1. In some embodiments, the trailing element 20 can be disk-shaped and have a diameter D (see FIG. 2C) that is greater than the maximum dimension of the opening 5 in the connector 1. A round shape can also help distribute an impact more evenly when the trailing element 20 contacts the connector 1 to form a splice. The trailing element 20 can have one or more attachment features for securing the trailing element to the trailing end of the running tape 30. As shown in FIG. 2C, the trailing element can comprise apertures 21 through which the trailing end of the running tape 30 can be threaded and secured. As shown in FIG. 1, as the trailing element 20 contacts the body portion 2 of the connector 1, the trailing element is blocked from passing through the opening 5 and can engage the connector. In the engaged position shown in FIG. 1, the running tape 30 can transfer tension to the connector 1 via the trailing element 20 and the connector in turn can transfer tension to the staged tape 40 via the leading element, completing the splice.

Figure 3:
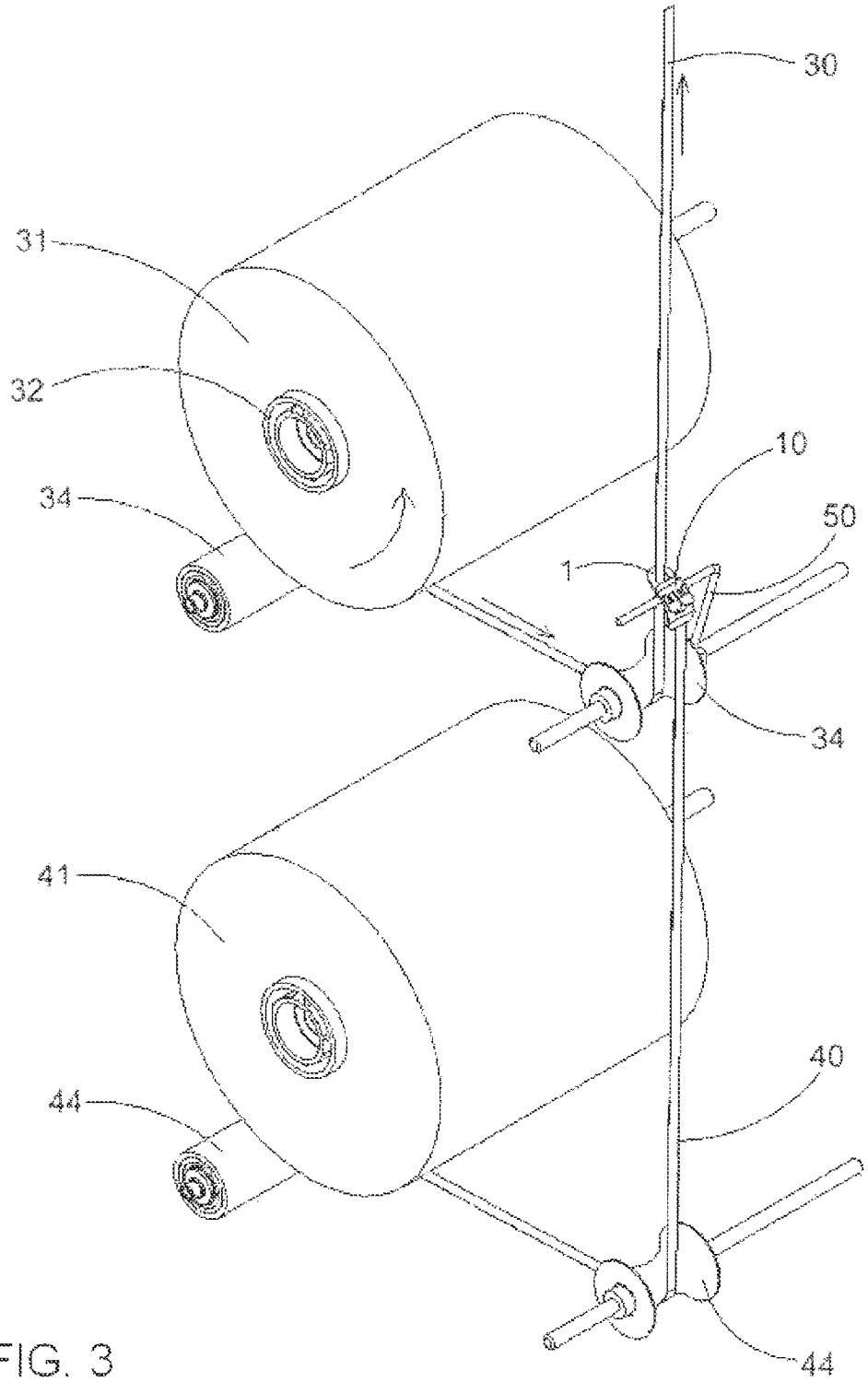
FIGS. 3-6 show an exemplary tape dispensing system that using the tape splicing system of FIG. 1.
Figure 4:
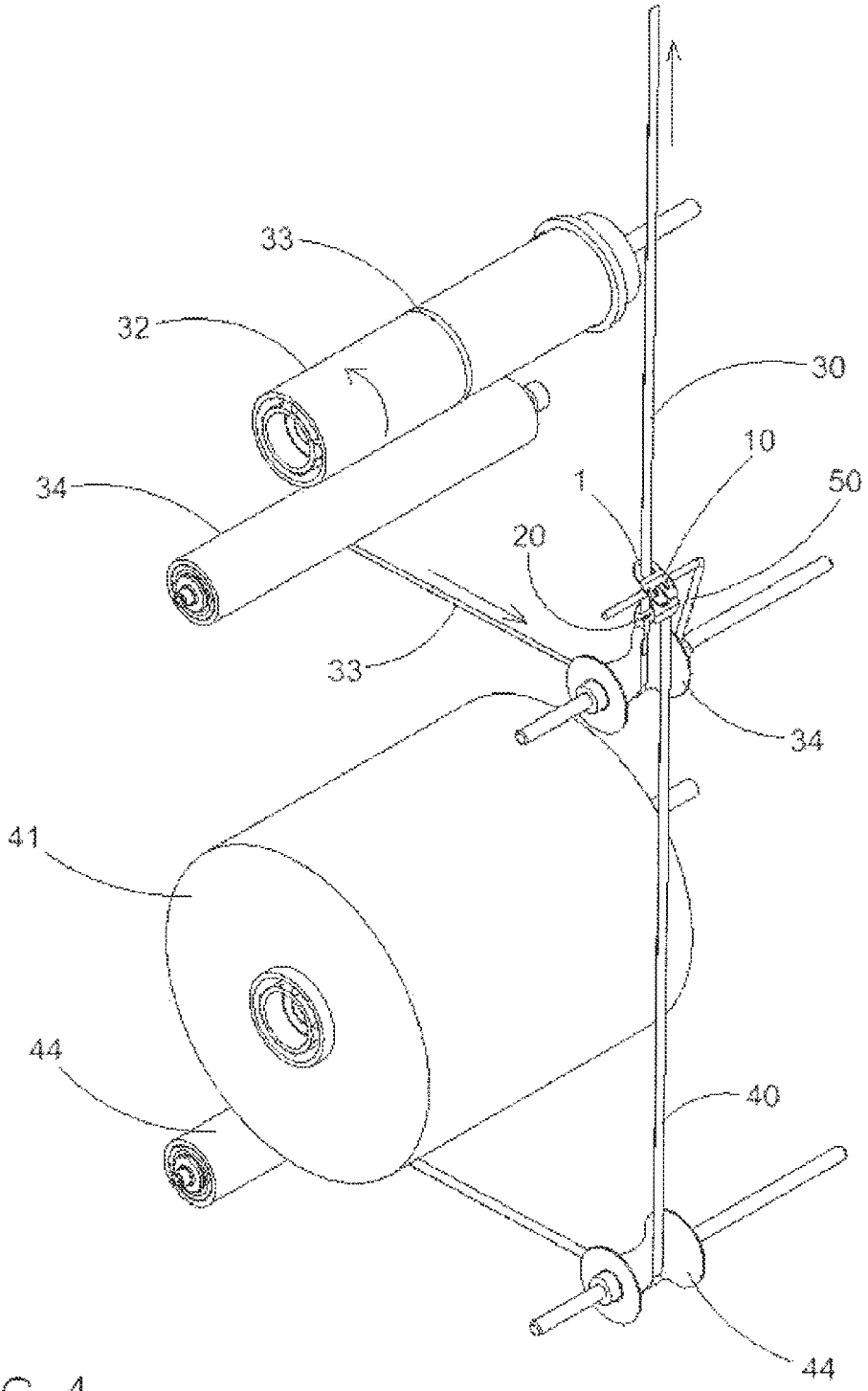
Figure 5:
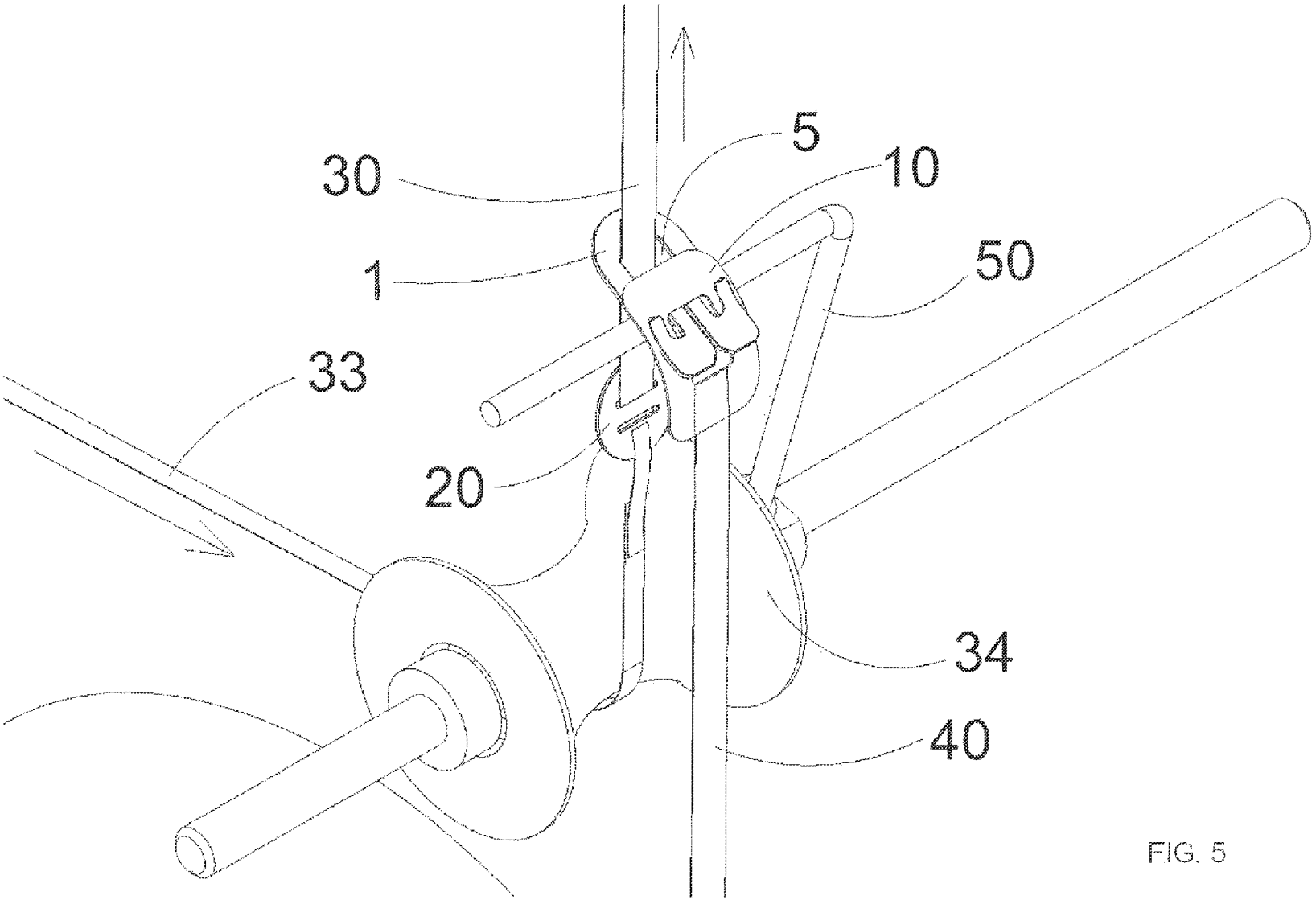

FIGS. 3-6 show an exemplary tape dispensing system within which the above described splicing system can be used. The tape dispensing system can comprise a running tape roll 31 and a staged tape roll 41. During a first phase, shown in FIG. 3, the running tape 30 is being dispensed from a rotating running roll 31, such as via one or more guide pulleys 34, while the staged tape 40 and staged roll 41 are stationary. The leading end of the staged tape 40 is secured to a leading end splicing element 10, which is engaged with a connector 1, which is positioned around the running tape 30 such that the running tape is running through the opening 5 in the connector. The connector 1 and leading element 10 can be held in place with the assistance of a bar or similar support mechanism 50, as shown in FIG. 5. The support mechanism 50 can be held stationary and can keep the connector 1 from sliding down the running tape 30 toward the pulley 34.

Prior to this first phase, shown in FIG. 3, an operator can position the connector 1 around an intermediate portion of the running tape 30, above the pulleys 34, while the running tape is running under tension. The operator can then position the leading element 10, with the leading end of the staged tape 40 secured to the leading element, around the foot portion 4 of the connector 1 and rotate the leading element to engage it around the neck portion 3 of the connector, as shown in FIG. 3.

During a second phase, as shown in FIGS. 4 and 5, the trailing end of the running tape is dispensed from the core 32 and the trailing element 20 passes around the pulleys 34 toward the connector 1. A tail portion 33 of the running tape can be releasably attached to the trailing element 20, to maintain tension on the trailing end of the running tape 30. The trailing end of the tail portion 33 can be secured to the core 32. The tail portion 33 can help guide the trailing element 20 around the pulleys 34 and into a desired alignment with the connector 1, especially at high tape-dispensing speeds, such as above 1000, 1300 and/or 1600 feet per minute.

Figure 6:
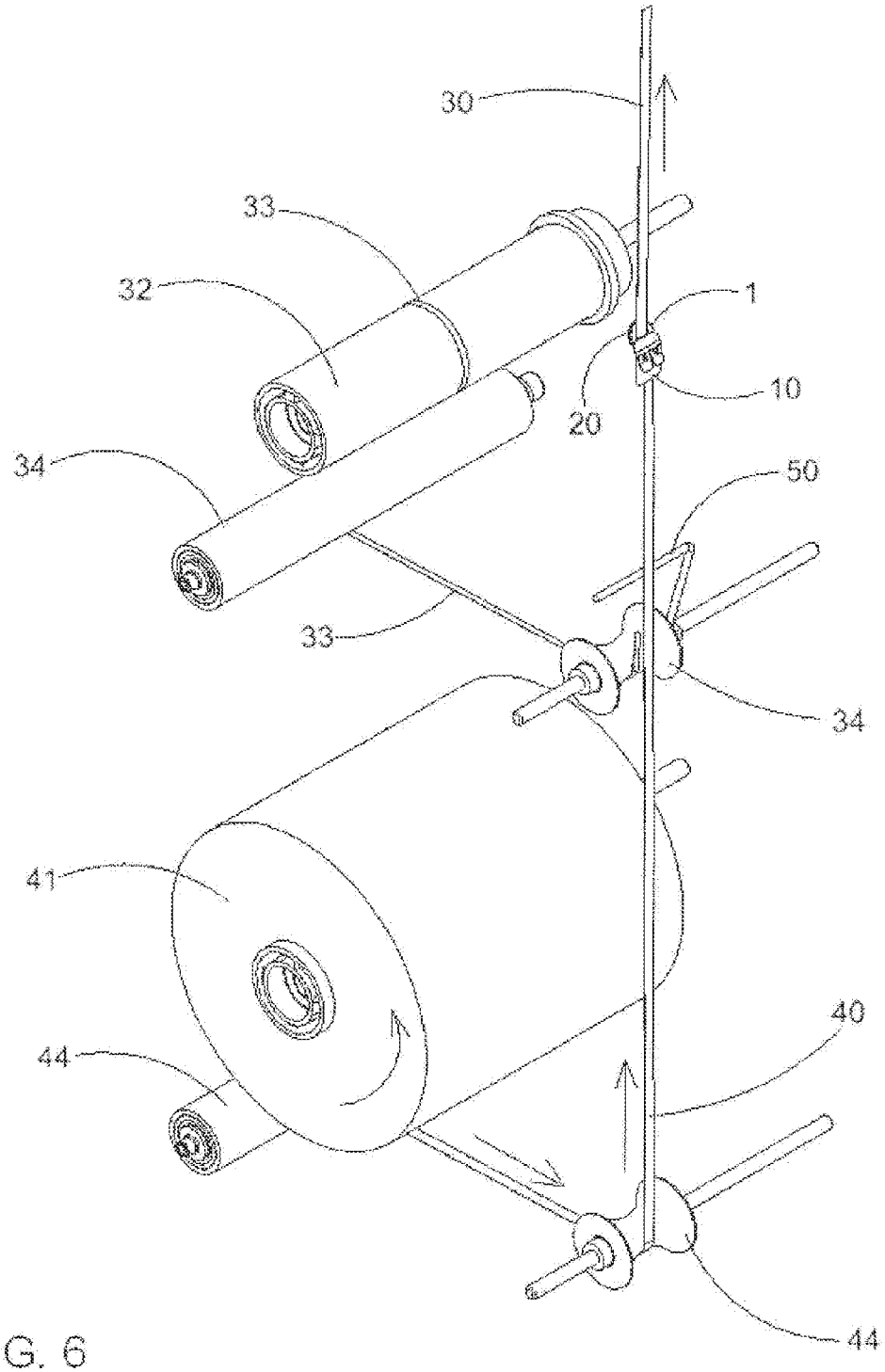

During a third phase, as shown in FIGS. 1 and 6, the trailing element 20 is engaged with the connector 1 and the splice is complete. As the trailing element 20 engages with the connector 1, tension from the running tape 30 is transferred through the splice and to the staged tape 40 and the staged roll 41, causing the staged roll 41 to begin rotating and dispensing the staged tape. After the splice is complete, the splice separates from the support mechanism 50. Because the break 6 is closed by the leading element 10 and running tape is blocked from escaping from the opening 5 of the connector 1 via the break, the less rigidity is required in the connector and the connector can thus be made thinner and/or more flexible. Increased flexibility can allow the connector 1 to better absorb loads imparted during splicing without failure.

Just before, while, or just after the trailing element 20 contacts the connector 1, the tail portion 33 can disconnect from the trailing element. As the tail portion 33 disconnects, tension is released from the tail portion and the core. The core 32 can then be removed from the system and replace with a fresh roll. The staged roll 41 thus can become a "running roll" and the fresh roll can become the "staged roll" and the process can be repeated to splice the fresh roll to the trailing end of the staged tape 40, which has become the "running tape." Like the running tape 30, the trailing end of the staged tape 40 can similarly include a trailing element 20 that can be spliced to a leading element 10 of the fresh roll using another connector 1. Each fresh tape roll that is added to the system can likewise comprise a leading element 10 secured to the leading end of the tape, a trailing element 20 secured to the trailing end of the tape and a tail portion 33 secured to the trialing element and the core 32. In some embodiments, each tape roll can also include a connector 1 pre-coupled in some manner to the roll. In other embodiments, a bulk source of connectors 1 can be provided independently of the tape rolls.

Additional disclosure relating to applicable tape dispensing machines and systems can be found in U.S. Pat. No. 7,461,808, which is incorporated by reference herein.

The splicing elements 1, 10 and/or 20 and the combined splice can be configured to be strong enough to bear the tension in the running tape without failure. In some embodiments, the splice and splicing elements can have tensile strengths at least equal to the tensile strength of the tapes being spliced. For example, the splicing elements and/or splicing systems described herein can be configured to withstand at least 25, 45, 65, and/or 110 pounds of tensile force. Similarly, the splicing elements and/or the splicing systems described herein can be configured to form splices between tapes at certain tape dispensing rates, such as at least 1000 feet per minute, at least 1300 feet per minute, and/or at least about 1600 feet per minute.

Splicing elements, such as the connector 1, the leading element 10 and the trailing element 20, can desirably be sufficiently thin and flexible such that when the splicing elements are pulled through a downstream machine, such as a corrugator, the splicing elements can safely pass through narrow openings, such as narrow gaps between rollers, and can bend around tight corners, such as around small pulleys or guides. The combination of the splicing elements in a splice, such as is shown in FIG. 1, can also be desirably thin and flexible for the same reasons. In the splice shown in FIG. 1, the trailing element 20 can be generally flush against the body portion 2 of the connector 1, making the sum of the thicknesses $T_1$ and $T_3$ a significant dimension. The same can be true for the sum of the thickness $T_1$ of the connector 1 and the thickness $T_2$ of the leading element 10. The thickness of the tapes can also be included in these overall splice thickness measurements. In some embodiments, the overall thickness of the splice can be less than a maximum thickness, which can be based on the dimensions of downstream equipment for example. The maximum thickness can be, for example, about 0.5 mm to about 3 mm.

One or more of the splicing elements described herein can comprise a thermoplastic material that melts when heated during downstream processing.

Figure 7:
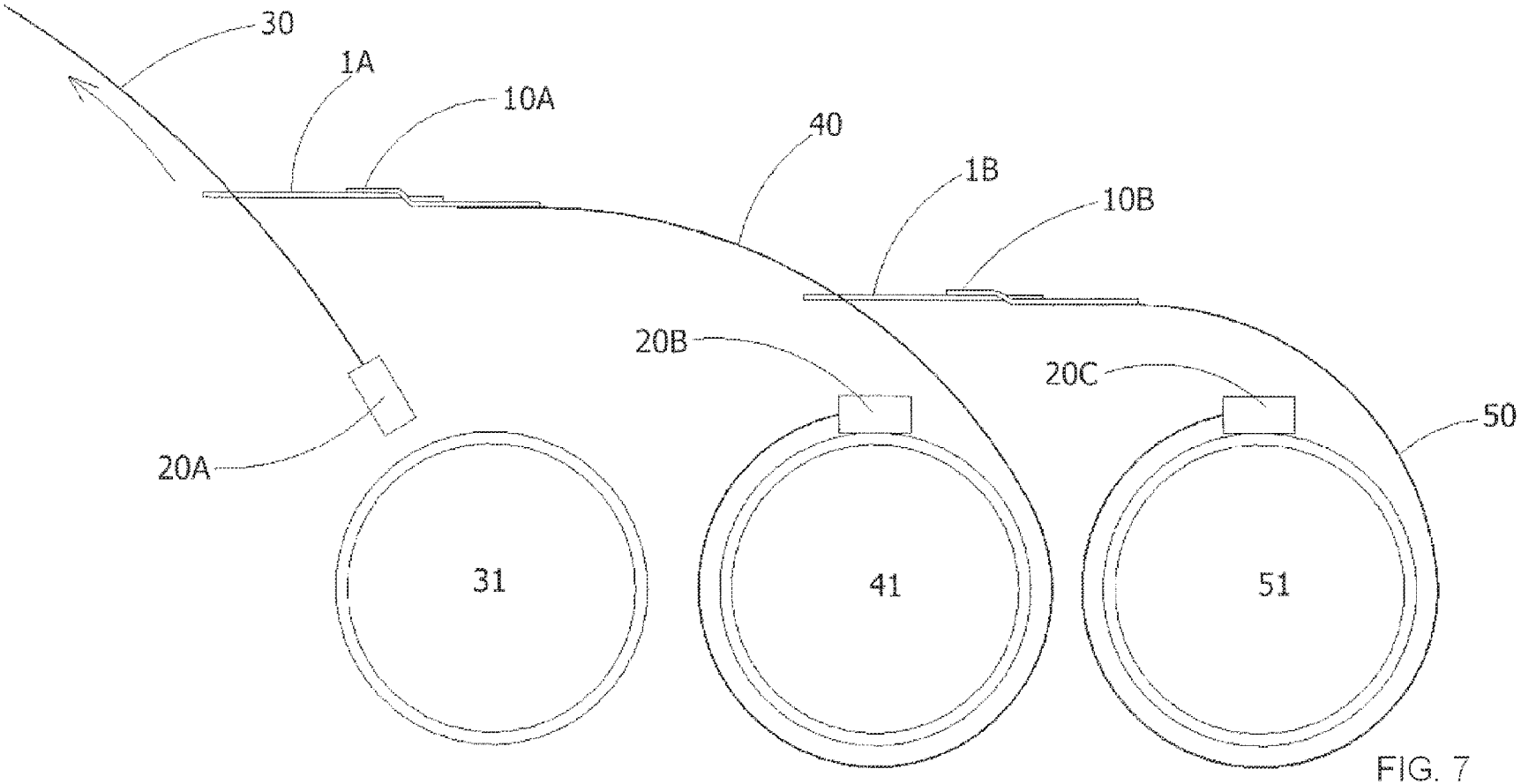
FIG. 7 shows an exemplary tape splicing system for splicing more than two rolls of tape.

FIG. 7 illustrates a multi-splice splicing system embodiment having a running roll 31, a first staged roll 41 and a second staged roll 51. A first connector 1A is positioned around the running tape 30 and a first leading element 10A of the first staged tape 40 is engaged with the first connector 1. A second connector 1B is positioned around the first staged tape 40 and a second leading element 10B of the second staged tape 50 is engaged with the second connector 1B. As the running tape 30 pulls the first trailing element 20A from the running roll 31 (just later in time from the position shown in FIG. 7), the first trailing element 20A contacts the first connector 1A and transfers tension from the running tape 30 to the first staged tape 40, completing a first splice. This causes the first staged roll 41 to begin rotating and dispensing the first staged tape 40. At that point in time, the core of the running roll 31 can be removed and replaced with a fresh tape roll. When the first staged roll 41 is depleted of tape and the second trailing element 20B contacts the second connector 1B, the tension in the tape 40 is transferred to the second staged tape 50, completing a second splice. The core of the roll 41 can then be removed and replaced with a fresh tape roll. The second splice causes the second staged roll 51 to begin rotating and dispensing the tape 50 until the third trailing element 20C is dispensed. This multi-roll, multi-splicing process can continue to include any number of new rolls in this manner. A further description of apparatuses and methods for splicing multiple rolls of tape together can be found in U.S. Patent Publication No. 2010/0123037 A1, which is incorporated by reference herein.

Figure 8:
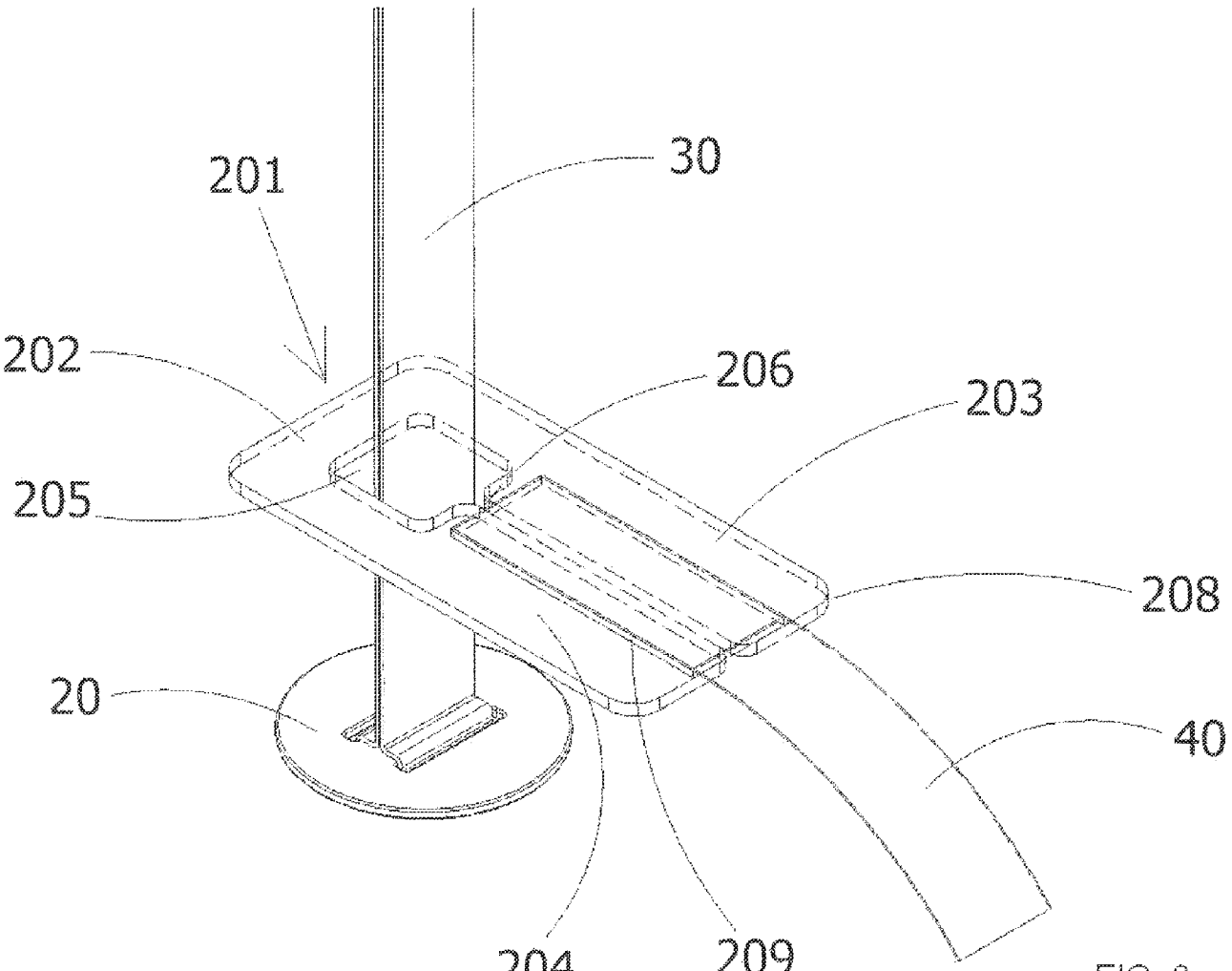
FIGS. 8-10 shows alternative embodiments of the tape splicing system shown in FIG. 1.
Figure 9:
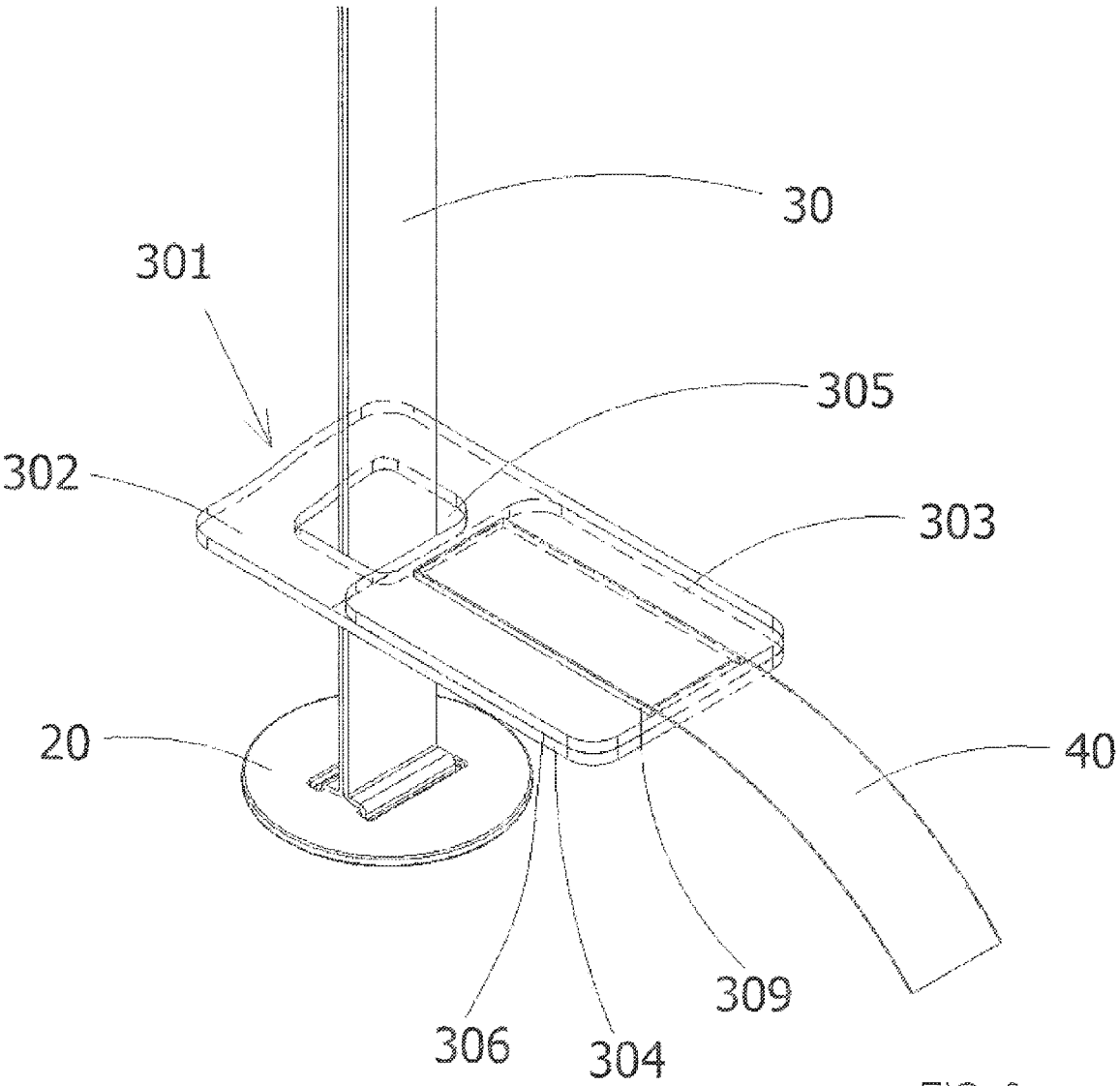
Figure 10:
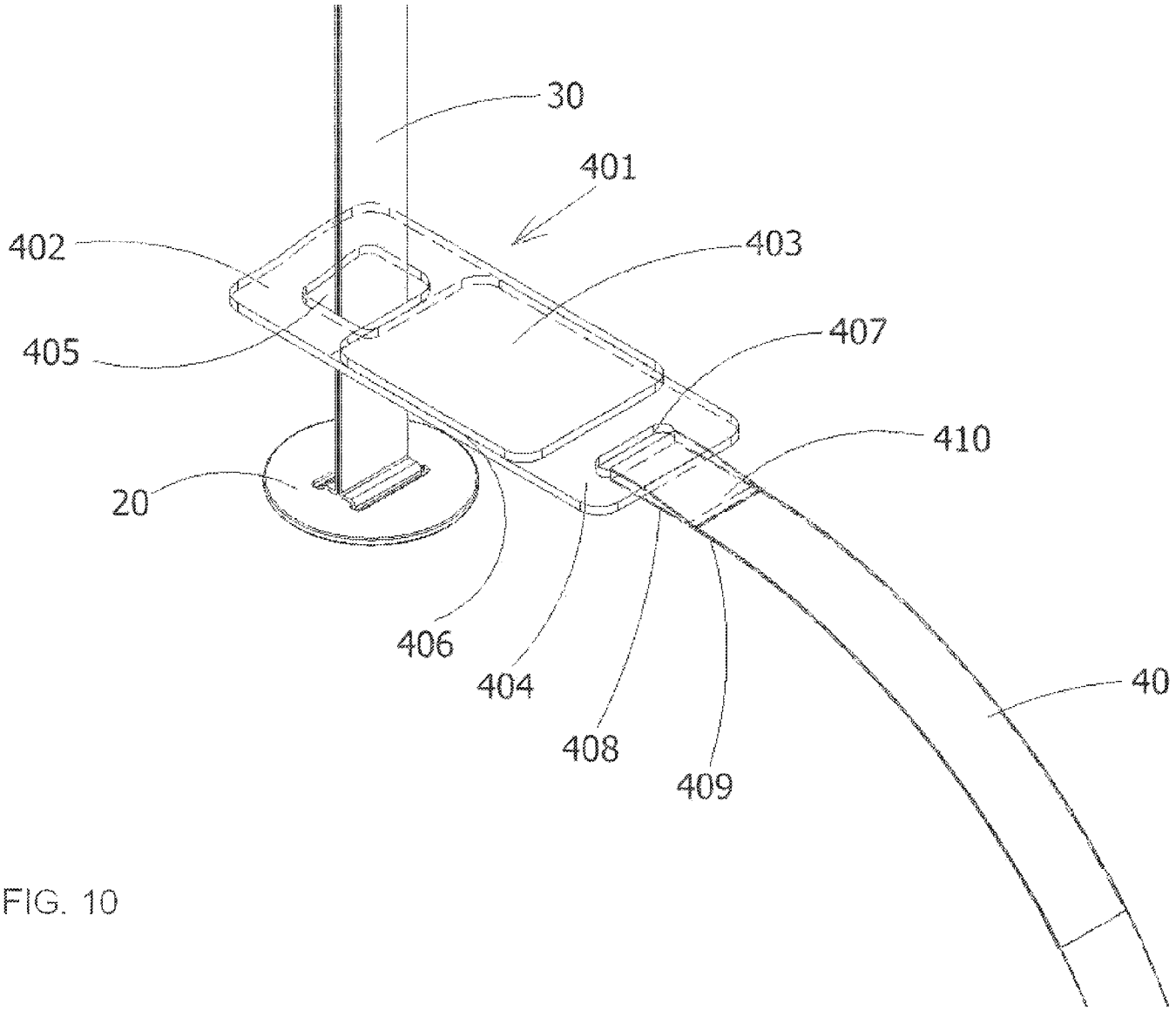
Figure 11:
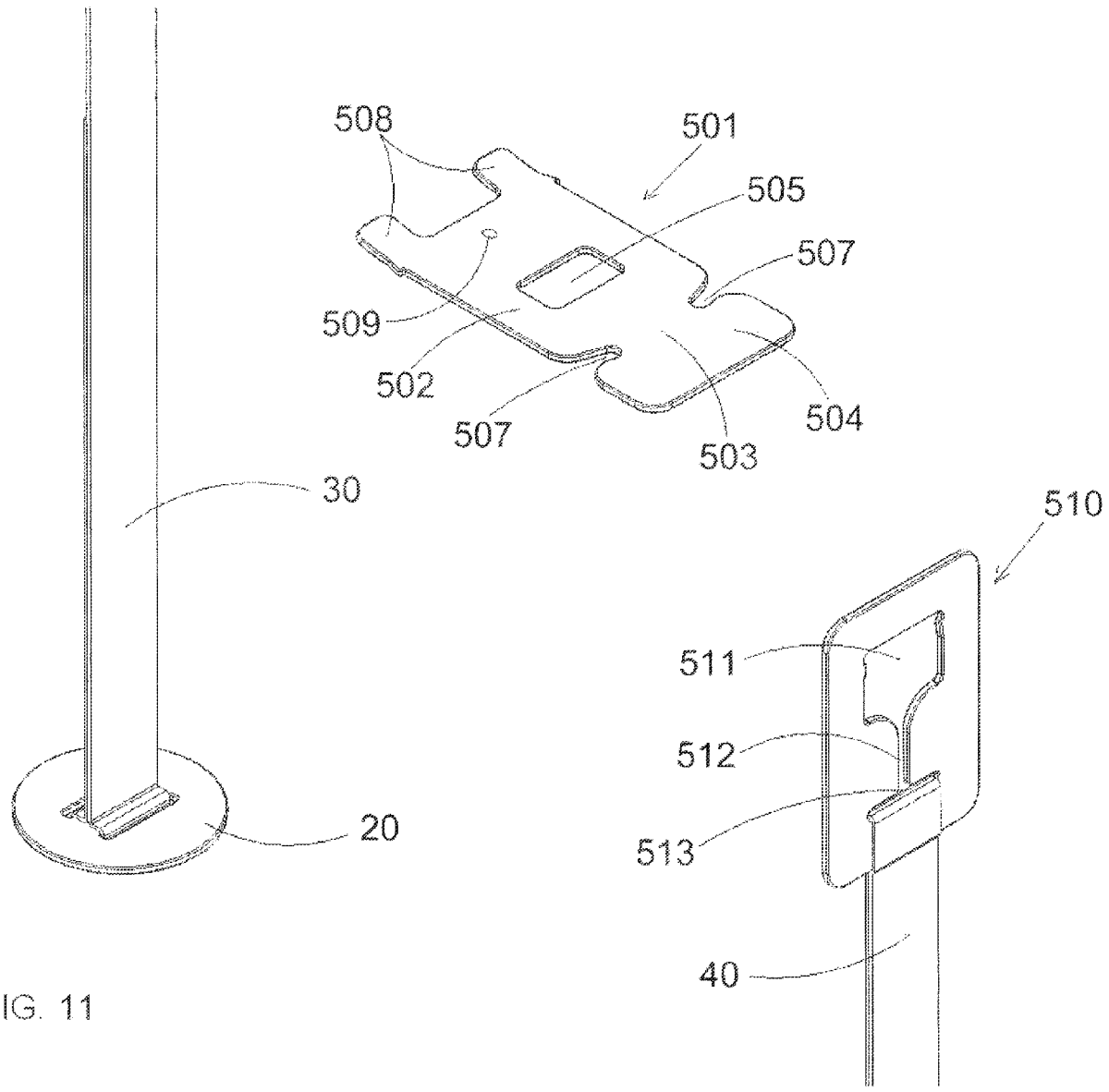
FIGS. 11 and 12 show another alternative tape splicing system.

FIGS. 8-10 show alternative embodiments of the splicing system. FIG. 8 shows an exemplary splicing system comprising a connector 201. The connector 201 comprises a body portion 202 and two legs 203, 204. An opening 205 is formed by the body portion 202 and a break 206 extends between the legs from the opening to a peripheral edge 208. The connector 201 can be positioned around the running tape 202 by inserting the tape through the break 206 and into the opening 205. The staged tape 40 can be secured to the connector 201 without an additional splicing element, such as the leading end splicing element 10. For example, the leading end of the staged tape 40 can be secured to the connector 201 with an adhesive 209, such as a pressure sensitive adhesive. The leading end of the staged tape 40 can overlap portions of both legs 203, 204 (as shown in FIG. 8) and can bridge the break 206 to inhibit the running tape 30 from sliding out of the opening 205 through the break. The adhesive 209 can be pre-applied to the leading end of each roll of tape and/or to the connector 201, optionally with a peel-away cover layer. In operation, an operator can position the connector 201 around the running tape 30, expose the adhesive, and then press the leading end of the staged tape 40 with the adhesive 209 against the legs 203, 204 to simultaneously secure the staged tape to the connector and bridge the break 206.

FIG. 9 shows another exemplary splicing system comprising a connector 301. The connector 301 comprises a body portion 302 and two legs 303, 304. An opening 305 is formed by the body portion 302. The legs 303, 304 can overlap and be in contact with one another, forming a break 306 between the legs. The connector 301 can be positioned around the running tape 302 by separating the legs 303, 304 apart and sliding the running tape between the legs and into the opening 205. In some embodiments, the connector 301 can further comprise and adhesive, such as a pressure sensitive adhesive, between the legs 303, 304, such that an operator and squeeze the legs together to enclose the opening 305 after the connector 301 has been positioned around the running tape 30. The staged tape 40 can be secured to the connector 301 without an intermediate splicing element. For example, the leading end of the staged tape 40 can be secured to the leg 303 with an adhesive 309, such as a pressure sensitive adhesive. In operation, an operator can position the connector 301 around the running tape 30, press the leading end of the staged tape 40 with the adhesive 209 against the leg 303, and squeeze the tape 40 and the legs 303, 304 together to secure the staged tape to the connector and secure the legs together. Optionally, the operator can first squeeze the legs together to set the pressure sensitive adhesive between the legs and then apply the staged tape to the leg 303.

FIG. 10 shows yet another exemplary splicing system comprising a connector 401. The connector 401 comprises a body portion 402 and two legs 403, 404. An opening 405 is formed by the body portion 402. The legs 403, 404 can overlap and be in contact with one another, forming a break 406 between the legs. The leg 404 can be longer than leg 403 and comprise an end portion 404 that comprises an aperture 407, as shown in FIG. 10. The connector 401 can be positioned around the running tape 402 by separating the legs 403, 404 apart and sliding the running tape between the legs and into the opening 405. In some embodiments, the connector 401 can further comprise and adhesive, such as a pressure sensitive adhesive, between the legs 403, 404, such that an operator and squeeze the legs together to enclose the opening 405 after the connector 401 has been positioned around the running tape 30. The staged tape 40 can be secured to the connector 401 without an intermediate splicing element. For example, the leading end of the staged tape 40 can be secured to the connector 401 by threading the an end portion 408 of the staged tape 40 through the aperture 407 and securing the end portion 408 to an intermediate portion 410 of the tape, such as with an adhesive 409, such as a pressure sensitive adhesive. In operation, an operator can first position the connector 401 around the running tape 30 and squeeze the legs 303, 304 together to secure the legs together, and then secure the tape through the aperture 407. Alternatively, the operator can first secure the tape 40 through the aperture 407, then position the connector around the running tape 30 and squeeze the legs together to set the pressure sensitive adhesive between the legs.

FIGS. 11-14 show yet another exemplary splicing system comprising a connector 501 and a leading end splicing element 510. The connector 501 can comprise a body portion 502, a neck portion 503 and a foot portion 504. The body portion 502 can form an enclosed opening 505. A pair of notches 507 can be formed on opposite sides of the neck portion 503. The connector 501 can further comprise one or more tabs 508 extending from the body portion 502 opposite the foot portion 504.

The leading element 510 can comprise a loop of pliant material, like the leading element 10. The leading element 510 can form an enclosed opening 511 having a slot portion 512 and a tape engagement opening 513. In some embodiments, the tape engagement opening 513 can be a separate opening from the opening 511. The leading end of the staged tape 40 can be threaded through the tape engagement opening 513 and folded over and secured to an intermediate portion of the tape to secure the tape to the leading element 510. In some embodiments, the leading element 510 can be pre-secured to the leading end of the tape on each roll of tape.

Figure 12:
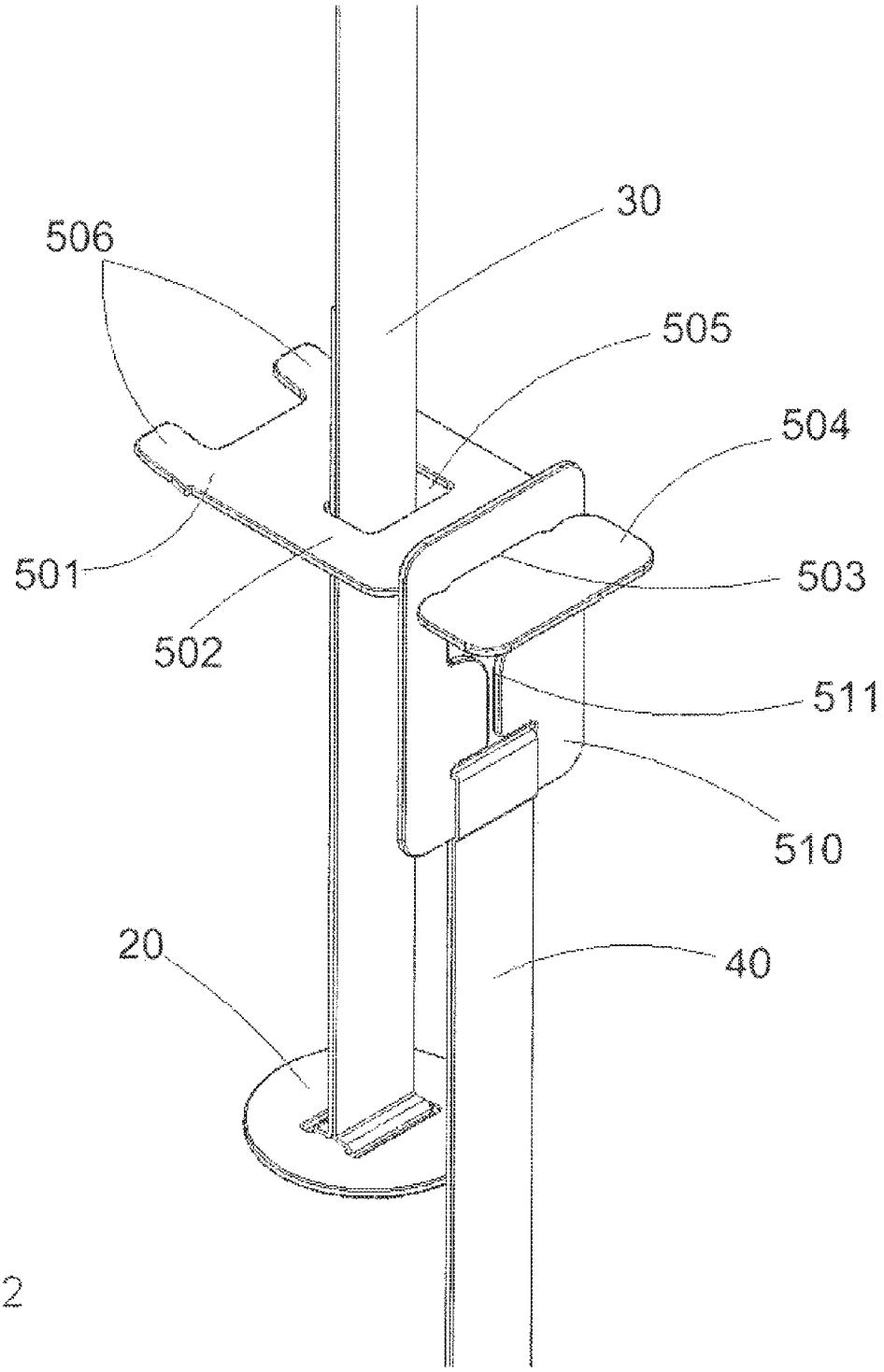

As shown in FIG. 12, the leading element 510 can be connected to, or interlocked with, the connector 501 by positioning the opening 511 of the leading element around the neck portion 503 of the connector. The leading element 510 can be sufficiently pliable to configure the opening 511 to fit around the broader foot portion 504 and engage the leading element into the notches 507 of the connector.

Because the opening 505 of the connector 501 is enclosed and does not include a break to allow the connector to be positioned around tape being dispensed (like the embodiment of FIG. 1), the connector can be positioned around the running tape 30 by threading a leading end portion of the running tape through the opening 505 before the tape starts running and before a leading element is secured to the leading end of the tape. In some embodiments, each roll of tape can comprise a pre-installed connector 501 positioned around the tape, a leading element 510 secured to the leading end of the tape, and a trailing element 20 secured to the trailing end of the tape.

Because the opening 505 of the connector 501 is fully enclosed (there is no break), less rigidity is required to keep the tape from escaping from the opening and the connector 501 can thus be made thinner and/or more flexible. Increased flexibility can allow the connector 501 to better absorb loads imparted during splicing without failure.

Figure 13:
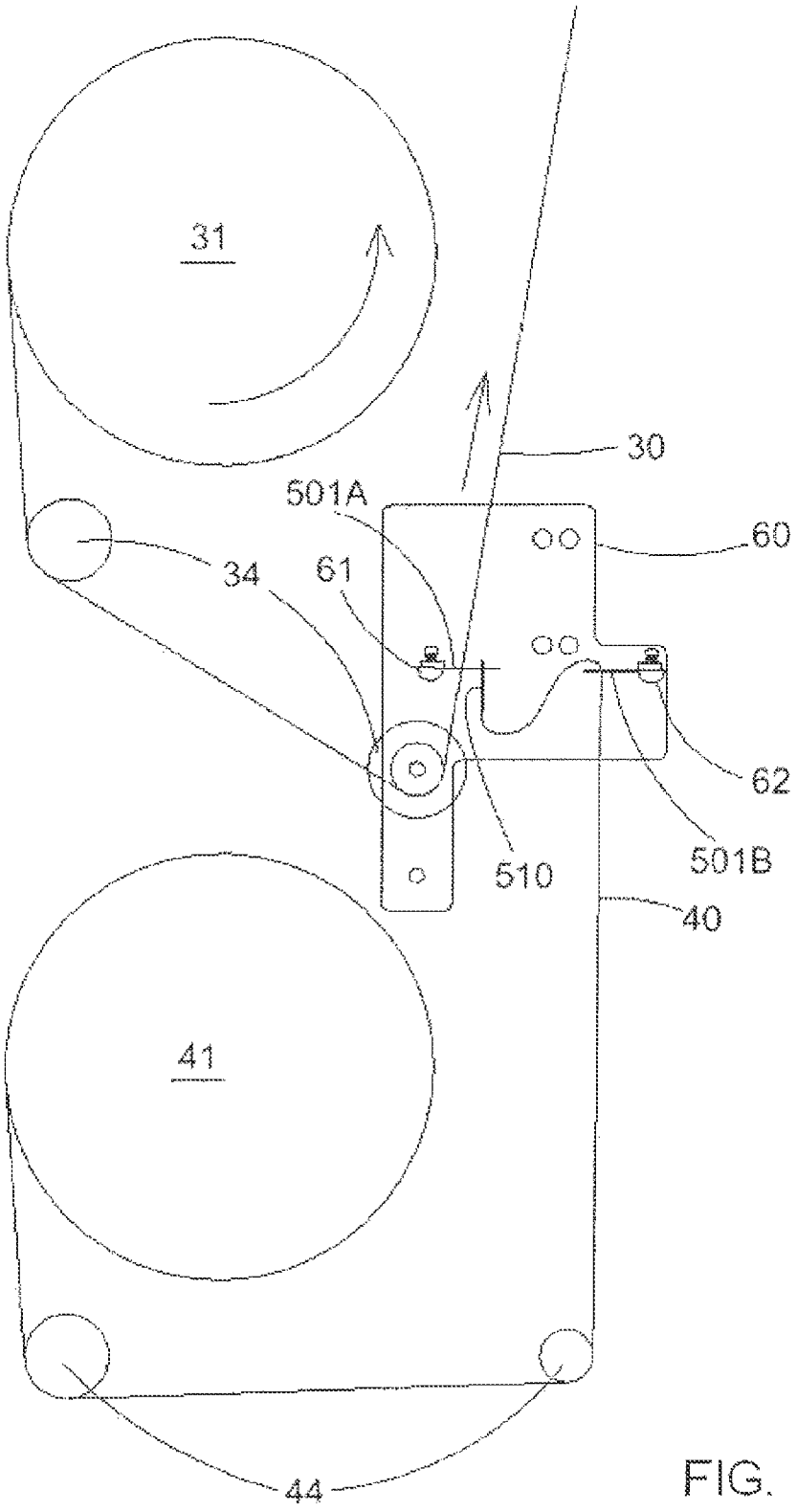
FIGS. 13 and 14 show an exemplary tape dispensing system using the tape splicing system of FIGS. 11 and 12.
Figure 14:
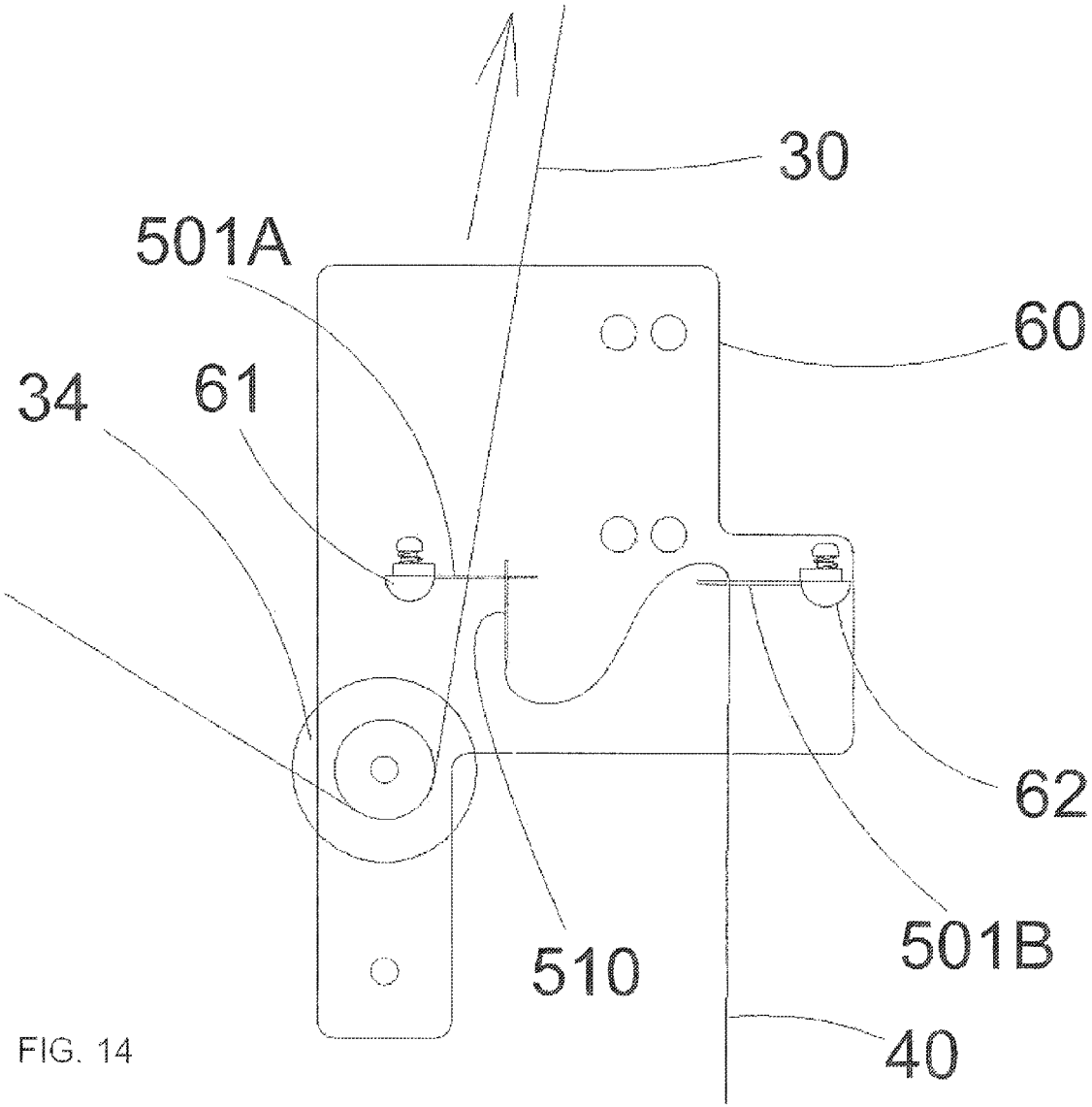

FIGS. 13 and 14 show an exemplary splicing system that can include splicing elements like the connector 501 and leading element 510. A frame 60 can comprise a first connector holder 61 and a second connector holder 62. The frame 60 can be a stationary portion of the system and can optionally also support one or more of the pulleys 34 and 44 and/or the tape rolls 31 and 41. The holders 61 and 62 can comprise releasable holding mechanisms that can hold the connectors 501A and 501B, respectively. For example, the holders 61, 62 engage with the tabs 508 (see FIG. 11) of the connectors 501 to temporarily hold the connectors in place. The connector 501A can be positioned in the holder 61 before the tape 30 starts running. The holder 61 can hold the connector 501A relatively stationary while the running tape is dispensed from roll 31, around pulleys 34 and through the opening 505 in the connector 501A. While the tape 30 is running, the staged tape 40 can be prepared to be spliced with the tape 30. The connector 501B of the staged tape 40 can be placed in the holder 62 and the leading element 510 of the staged tape 40 can be interlocked with the connector 501A with the opening 511 of the leading element 510 positioned around the neck portion 503 of the connector 501A. In this staged position, as shown in FIGS. 13 and 14, the staged tape 14 can have some slack between the connector 501B and the leading element 510. As the running tape 30 is depleted, the trailing element 20 secured to the trailing end of the tape 30 can pass around the pulleys 34 and engage with the body portion 502 of the connector 501A, pulling the connector 501A out of the holder 61 and transferring tension from the running tape 30 to the staged tape 40 and completing the splice.

As the trailing element 20, connector 501A and the leading element 510 are pulled away by the running tape 30, the staged tape 40 can begin running from the roll 41, around pulleys 44 and through the opening 505 in the connector 501B while the connector 501B remains held relatively stationary by the holder 62. The depleted roll 31 can then be replace with a fresh tape roll. The connector 501 of the fresh tape roll can be placed in the holder 61 and the leading element 510 can be interlocked with the connector 501B that is being held in the holder 62. In this manner, a plurality of tape rolls can continually be spliced together to provide any desired length of continuous running tape.

Figure 15:
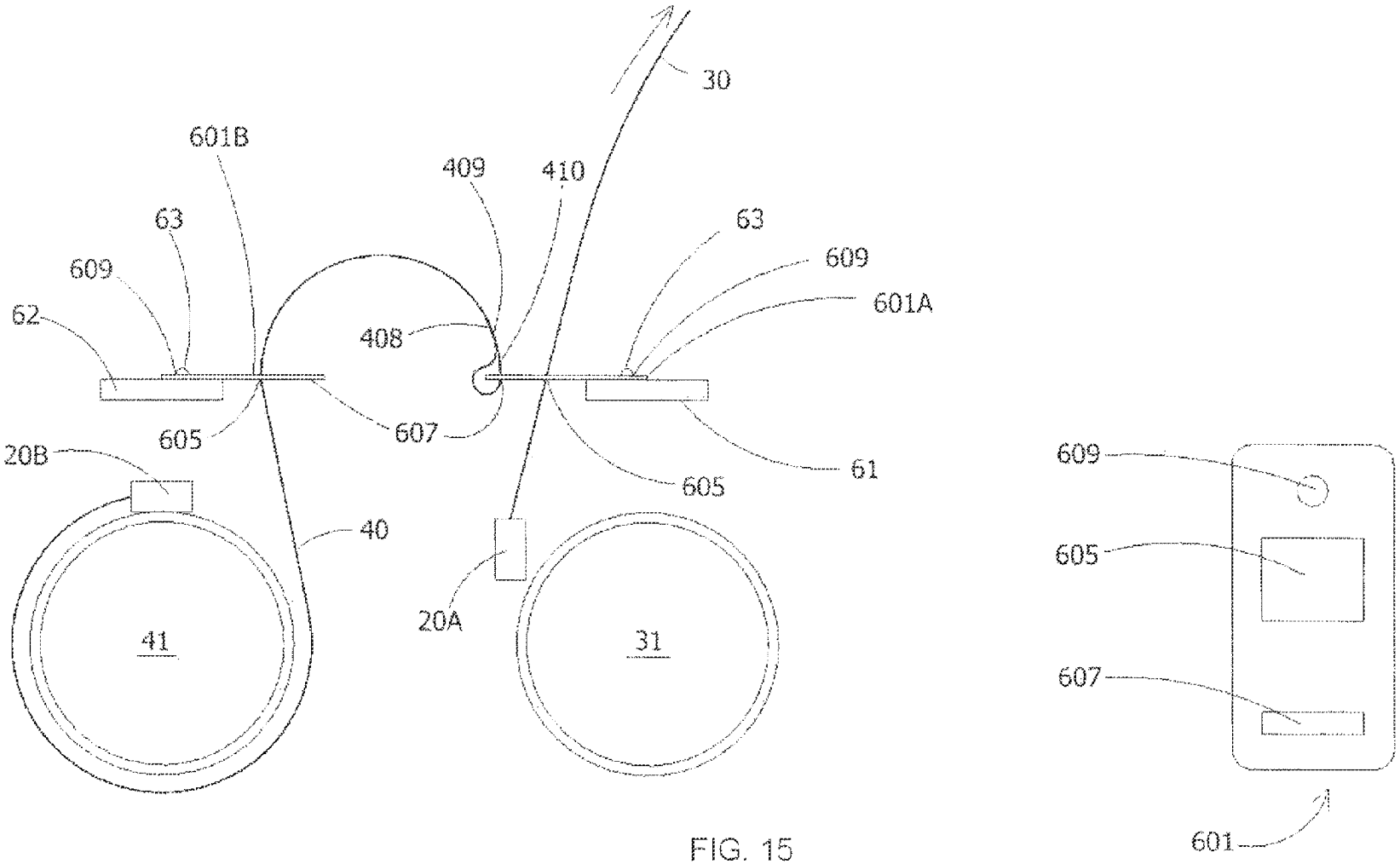
FIG. 15 shows an alternative embodiment of the splicing system of FIGS. 11-14.

FIG. 15 shows an alternative embodiment of the splicing system shown in FIGS. 13 and 14 comprising connectors 601. The connectors 601 can comprise a first opening 605 for allowing running tape 30 to pass through, a second opening 607 for securing the connectors to a leading end of the staged tape 40, and a third aperture 609 for connecting the connectors to the holders 61, 62. The holders can comprise projections 63 that can pass through and engage with the openings 609 to temporarily hold the connectors 601 in place. The leading end portion 408 of the staged tape 40 can be threaded through the opening 607 and secured to an intermediate portion 410 of the tape, such as with an adhesive, to secure the tape 40 to the connector 601A. As the trailing element 20A of the running tape 30 engages with the connector 601A, the connector 601A is separated from the holder 61 and tension in the running tape is transferred to the staged tape 40. This process can be continually repeated, as described above, to provide any desired length of running tape.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A tape splicing system, comprising:

a running roll of tape having a trailing end portion and a trailing end splicing element secured to the trailing end portion;

a staged roll of tape having a leading end portion; and a connector having an opening and a securing portion, the securing portion being adapted to be secured to the leading end portion of the staged roll of tape, the connector being positionable around running tape from the running roll while the running tape is being dispensed such that the running tape runs through the opening in the connector, wherein the leading end portion of the staged roll of tape can be secured to the securing portion of the connector while the running tape is being dispensed from the running roll and is running through the opening in the connector, such that when the running roll becomes depleted of tape, the trailing end splicing element engages the connector so as to splice the running tape to tape from the staged roll of tape;

wherein the trailing end splicing element, the connector, and the leading end portion of the staged roll of tape join to form a splice that runs with the running tape and the staged tape.

2. The system of claim 1, wherein the leading end portion of the staged tape is secured to the securing portion of the connector with an adhesive.

3. The system of claim 1, wherein the connector further comprises a break extending from the opening of the connector to a peripheral edge of the securing portion such that the running tape is insertable through the break into the opening of the connector while the running tape is running.

4. The system of claim 3, wherein the securing portion of the connector comprises first and second leg portions, and the break extends between the leg portions.

5. The system of claim 4, wherein the leading end portion of the staged tape is securable to the securing portion of the connector with an adhesive such that the leading end portion of the staged tape is adhesively attached to both the first and second leg portions and bridges the break, such that the leading end portion of the staged tape inhibits the running tape from moving out of the connector opening through the break.

6. The system of claim 4, wherein the first and second legs overlap each other and are adhesively securable to each other to close the break and prevent the running tape from exiting the opening in the connector through the break.

7. The system of claim 6, wherein the leading end portion of the staged roll of tape is adhesively secured to only one of the first and second legs to couple the staged tape to the connector.

8. The system of claim 6, wherein at least one of the first and second legs comprises an aperture opposite from the connector opening, and the leading end portion of the staged tape is securable to the connector by looping the leading end portion through the aperture and securing the leading end portion to itself with an adhesive.

9. The system of claim 1, wherein the trailing end portion of the running tape roll comprises a tail secured to a core of the running tape roll such that the running tape remains in tension until the trailing end splicing element approaches or contacts the connector.

10. A method for splicing tapes, the method comprising:

dispensing a running tape from a running roll, a connector being positioned around the running tape such that the dispensed running tape runs through an opening in the connector; and while the running tape is being dispensed through the opening in connector, securing a leading end portion of a staged tape to the connector;

whereby when the running roll becomes depleted of tape, a trailing end splicing element at a trailing end of the running tape engages the connector positioned around the running tape to splice the running tape to the staged tape such that the staged tape begins running and follows the running tape;

wherein the trailing end splicing element, the connector, and the leading end portion of the staged roll of tape join together to form a splice that runs with the running tape and the staged tape.

11. The method of claim 10, wherein the connector is pre-installed around the running tape on the running roll before the running tape is dispensed from the running roll.

12. The method of claim 10, wherein the connector is placed around the running tape during the dispensing of the running tape from the roll.

13. The method of claim 10, further comprising:

positioning the connector in a releasable holding mechanism, which holds the connector substantially stationary while tape is dispensed from the running roll and then releases the connector when the splice is formed.

14. The method of claim 10, wherein the leading end portion of the staged tape is secured to the connector with an adhesive.

15. The method of claim 14, wherein the connector comprises two legs with a break between the two legs, and the method comprises passing the running tape through the break into the opening in the connector and then adhesively securing the leading end portion of the staged tape over the break to prevent the running tape from exiting the connector through the break.

16. The method of claim 14, wherein the connector comprises two overlapping legs with a break between the two legs, and the method comprises passing the running tape through the break into the opening in the connector and then adhesively securing the two legs together to prevent the running tape from exiting the connector through the break.

17. The method of claim 16, wherein the method further comprises adhesively securing the leading end portion of the staged tape to only one of the first and second legs.

18. The system of claim 1, wherein the leading end portion of the staged roll of tape comprises a looped end portion of the staged roll of tape.

* * * * *